United States Patent [19]

Jeffcoat

[11] 3,990,271

[45] Nov. 9, 1976

[54] KNITTING METHOD

[75] Inventor: Keith Jeffcoat, Nuneaton, England

[73] Assignee: Courtaulds Limited, London, England

[22] Filed: Jan. 5, 1976

[21] Appl. No.: 646,577

[52] U.S. Cl. ..... 66/176

[51] Int. Cl.[2] ..... A41B 9/06

[58] Field of Search ..... 66/176, 177, 175, 60, 66/64, 70

[56] References Cited

UNITED STATES PATENTS

| | | | |
|---|---|---|---|
| 294,637 | 3/1884 | Kreisel | 66/176 |
| 412,055 | 10/1889 | Williams | 66/176 |
| 3,057,178 | 10/1962 | Konklin | 66/176 |

FOREIGN PATENTS OR APPLICATIONS

| | | | |
|---|---|---|---|
| 1,494,335 | 7/1967 | France | 66/176 |
| 15,780 | 8/1892 | United Kingdom | 66/176 |

*Primary Examiner*—Ronald Feldbaum
*Attorney, Agent, or Firm*—Davis, Hoxie, Faithfull & Hapgood

[57] ABSTRACT

A method of knitting a blank for a sleeved garment on a knitting machine having two opposed needle beds containing independently operable needles, comprises, in either order, the steps of forming two sleeve portions of the blank, each extending between a cuff and an underarm level of a sleeve of the garment, by knitting in reciprocatory manner on needles of the two opposed needle beds at two locations to form U-shaped courses, the joined ends of the two arms of each U-shaped course of a sleeve portion lying on the needle beds adjacent the joined ends of a corresponding U-shaped course of the other sleeve portion, and forming two body portions of the blank by knitting separately two pieces of fabric one on each of the two needle beds.

The method also comprises forming a shoulder region of the blank to constitute a connection between the sleeve portions and the body portions. This shoulder region comprises two sleeve shoulder portions formed by knitting U-shaped courses to constitute an extension of each sleeve portion and two body shoulder portions formed by knitting two pieces of fabric to constitute extensions of the two body portions. In the course of knitting one pair of the pairs of sleeve and body shoulder portions, needles are made progressively inactive in an inwards direction from the outermost edges of the pair of portions, without casting off loops from those needles, and in the course of knitting the other of the pairs of sleeve and body shoulder portions inactive needles holding knitted loops are brought progressively back into action in the opposite direction, whereby the sleeve and body shoulder portions are shaped and joined to one another and a one-piece blank is formed having sleeve portions each open down one edge and body portions separated at the sides.

3 Claims, 12 Drawing Figures

KNITTING METHOD

Figure 1:
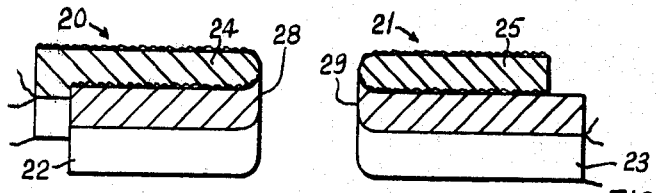

This invention relates to a method of manufacturing a sleeved garment by a knitting process which produces a garment blank subsequently requiring some making-up in order to produce the finished garment. The method has the advantage that sleeve portions, shoulder regions and body portions of the garment are integrally knitted together in producing the blank which thus comprises all the major parts of the garment. The only joins required to complete the garment are a longitudinal join along each sleeve and a side join at each side of the body. Further major advantages of this method are that the blank is produced in a form suitable for striped and other patterning and that it can be carried out on existing flat V-bed knitting machines, preferably, modified by incorporation of a device for pressing down the knitted fabric from above as an alternative to conventional roller take down. Such a device is described, for example, in British patent specification No. 1,288,043 (corresponding to U.S. Pat. No. 3,613,401) and facilitates the carrying out of knitting operations in which some needles are taken out of action whilst still holding their loops and other adjacent needles continue to knit.

In relation to striped knitting, problems arise as to how to dispose of long floating lengths of yarn which initially extend between stripes of the same colour. Whilst stripes of other colours are being knitted, yarn of one colour is not utilised and is not incorporated in the knitted structure. Consequently, when this yarn is used again a float or free length of yarn is formed between its previous position of incorporation in the fabric and its new position of incorporation. This is totally unacceptable on the outside of a garment and if the loops occur there, they must be cut and drawn in and tied off. Whilst not being limited to striped garments, the present invention provides an advantageous method of producing such garments, because the floats of yarn can be formed at the side edges of the body portions and the edges of the sleeve portions in the blank which require subsequent seaming and the floats are thus hemmed in or cut away according to the seaming method used. Floats of yarn at the knitted sleeve-body joins are formed inside the garment and are therefore, in general, more acceptable.

Long floats are also found along the edges of the fabric in forms of patterning other than striping and thus the method according to the invention can also be used with advantage to manufacture garments incorporating these other forms of patterning. In addition, each sleeve and its shoulder portion are knitted in the same yarn by the same knitting procedure throughout, involving the formation of U-shaped courses of knitting in both. Each body panel and its shoulder portion are also knitted in the same yarn by the same knitting procedure throughout. This uniformity of yarn and knitting procedure in sleeves and body and their respective shoulder regions tends to produce a uniform appearance of these parts in the finished garments. This advantage applies whether or not the garment is striped or patterned.

A method according to the invention of knitting a blank for a sleeved garment on a knitting machine having two opposed needle beds containing independently operable needles, comprises, in either order, the steps of (a) forming two sleeve portions of the blank, each extending between a cuff and an underarm level of a sleeve of the garment, by knitting in reciprocatory manner on needles of the two opposed needle beds at two locations to form U-shaped courses, the joined ends of the two arms of each U-shaped course of each sleeve portion lying on the needle beds adjacent the joined ends of a corresponding U-shaped course of the other sleeve portion, and (b) forming two body portions of the blank by knitting separately two pieces of fabric one on each of the two needle beds, said method also comprising (c) forming a shoulder region of the blank to constitute a connection between the sleeve portions and the body portions, said shoulder region comprising two sleeve shoulder portions formed by knitting U-shaped courses to constitute an extension of each sleeve portion and two body shoulder portions formed by knitting two pieces of fabric to constitute extensions of said two body portions, and in the course of knitting one pair of said pairs of sleeve and body shoulder portions, making needles progressively inactive in an inwards direction from the outermost edges of the pair of portions, without casting off loops from those needles, and in the course of knitting the other of said pairs of sleeve and body shoulder portions bringing inactive needles holding knitted loops progressively back into operation in the opposite direction whereby the sleeve and body shoulder portions are shaped and joined to one another and a one-piece blank is formed having sleeve portions each open down one edge and body portions separated at the sides.

After knitting, the blank is seamed longitudinally along each sleeve portion to join the free ends of the successive U-shaped courses together. The adjacent side edges of the body portion are also seamed together and preferably, in these seaming operations, the extreme edges of the parts concerned are removed.

The invention includes a blank made by the method just described and a garment made from such a blank. The invention will be further described by way of example with reference to the accompanying drawings in which, FIGS. 1 to 5 are general diagrammatic views of a garment blank according to the invention in different stages of manufacture, FIGS. 6 to 11 are diagrams illustrating courses knitted on the machine at various stages of manufacture of the blank of FIGS. 1 to 5, and FIG.12 is a general view of a finished blank according to one embodiment of the invention.

The knitting method to be described can be carried out on a conventional flat V-bed knitting machine with independently selectable needles and having reciprocating cam boxes with cam tracks for cooperation with the butts of needles slidably mounted in tricks in the needle beds and also having a plurality of yarn carriers to supply yarn to the needles for the production of knitted loops thereon. One example of such a machine on which the present method can be carried out is the machine designated "JDR" which is manufactured by the firm Edouard Dubied et Cie S.A. of Neuchatel, Switzerland. The JDR machine is described and illustrated in U.S. Pat. No. 3,304,748. To enable it to carry out the present invention in a preferred manner, the JDR machine is modified by removal of the standard take-down rollers and incorporation of a presser foot mechanism in their place, for example the presser foot mechanism described in British patent specification No. 1,288,043 (U.S. Pat. No. 3,613,401).

In the method to be described, the garment blank is knitted in the direction from the sleeve cuffs to the waist of the body and knitting is started using a set course as described in British patent specification No. 1,308,909 and a conventional mock rib construction. The method according to the invention will be described in relation to production of a striped blank.

FIG. 1 shows a stage in the knitting of a blank when sleeve portions 20 and 21 have just been started. Mock rib cuff portions 22 and 23 have been knitted followed by stripes 24 and 25. To accomplish this knitting process, yarn carriers (not shown) of the machine are moved to and fro across and the needle beds 26 and 27 (FIGS. 6 to 11) and the cam boxes (not shown) are controlled to operate needles in such a way that yarn is supplied to and knitted by the needles in the manner shown in FIG. 6. That is, starting from a previous course in which the last needle operated to knit the sleeve portion 20 was located in the needle bed 26, a further course A of the sleeve fabric 20 is knitted on needles of the bed 27 in the direction from right to left; a further course B is knitted on the same needles in the direction from left to right; a course C is next knitted on needles of the bed 26 in the direction from right to left and a final course D to complete the cycle is knitted on the same needles of bed 26 in the direction from left to right. Another cycle is then begun. The same traverses of the cam boxes as are used to knit the sleeve portion 20 are arranged to bring about needle operations and yarn carrier movements similar to those used in knitting the sleeve portion 20 in order to knit the sleeve portion 21. Thus, in the same cam box traverse as the course A is knitted in sleeve portion 20, the course $A^1$ is knitted in sleeve portion 21 and on the same needle bed 27. When course B is knitted in sleeve portion 20 on needle bed 27, course $B^1$ in sleeve portion 21 is knitted during the same traverse of the cam boxes on needle bed 26. Course $C^1$ is knitted on needle bed 26 in the same cam box traverse as course C and on the same bed and course $D^1$ is knitted on needle bed 26 in the same cam box traverse as the course D is knitted on needle bed 27.

Figure 6:
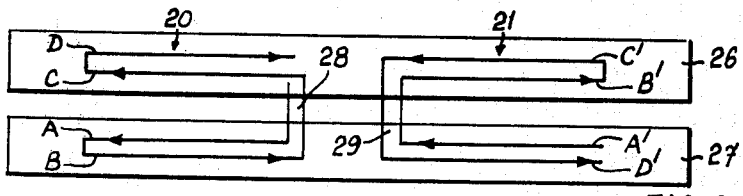

The formation of each of the sleeve portions 20 and 21 thus proceeds by knitting in recoprocatory manner on needles of the two opposed needle beds 26 and 27 to form U-shaped courses, the cycle of cam box traverses described with reference to FIG. 6 producing two U-shaped courses in each sleeve portion. The closed end 28 or 29 of each U-shaped course of the sleeve portion 20 lies on the needle beds adjacent the closed end $28^1$ or $29^1$ of the other sleeve portion 21.

Figure 7:
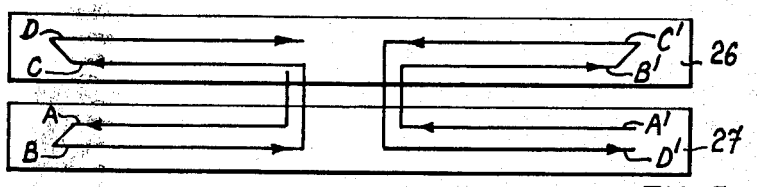

After knitting of the mock rib cuffs 22 and 23 and the first stripes 24 and 25, shaping of the sleeve portions 20 and 21 is commenced. Shaping by widening is effected (FIGS. 2 and 7) by introducing to knitting action previously inactive needles at the outer ends (that is the ends remote from the closed ends) of the U-shaped courses. Thus, needles are introduced, as shown in FIG. 7, by introducing inactive needles in courses B and D and in course $A^1$ and $C^1$. Widening is continued until the level 30 is reached in each sleeve portion (FIG. 2) and thereafter, two further stripes 33, 34 and 35, 36 are knitted in each sleeve portion to complete the main part of each sleeve portion as shown in FIG. 2.

The sleeve portions are shown as being knitted from yarn of three different colours, each colour being supplied from a different yarn carrier and a separate set of yarn carriers being required for each sleeve portion.

When a yarn carrier is not supplying yarn to needles, it is merely parked on its supporting rail in the usual way and as further fabric is knitted beyond the course in which the yarn carrier was parked, a floating length of yarn is formed from the yarn carrier to the point in the sleeve portion at which the yarn concerned was last knitted. When the yarn is knitted again, a floating length of the yarn is left extending free along the edge of the knitted fabric between the new point of entry of the yarn into the fabric and the point where it was previously knitted. Because of the number of stripes and colours involved in knitting the sleeve portions 20 and 21, a series of floating lengths of yarn 37 are left along the free edges 38 and 39 of the sleeve portions 20 and 21, it being these free edges 38 and 39 where yarn carriers are taken out of and introduced to knitting action.

Figure 2:
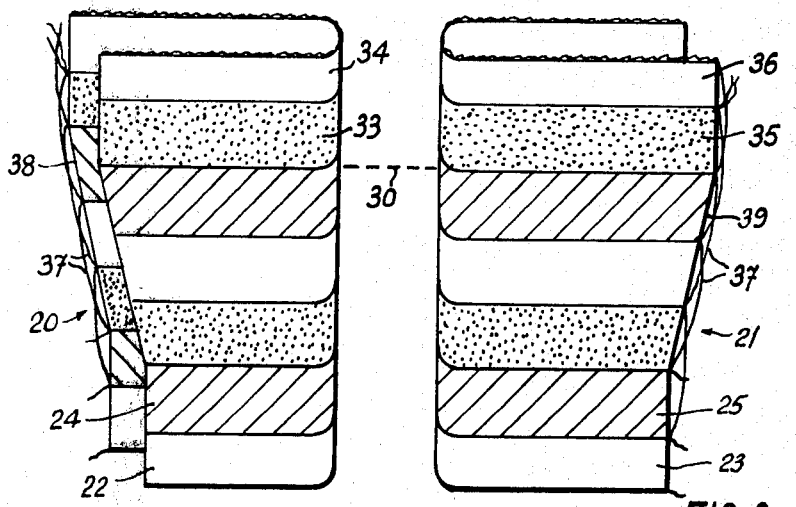
Figure 3:
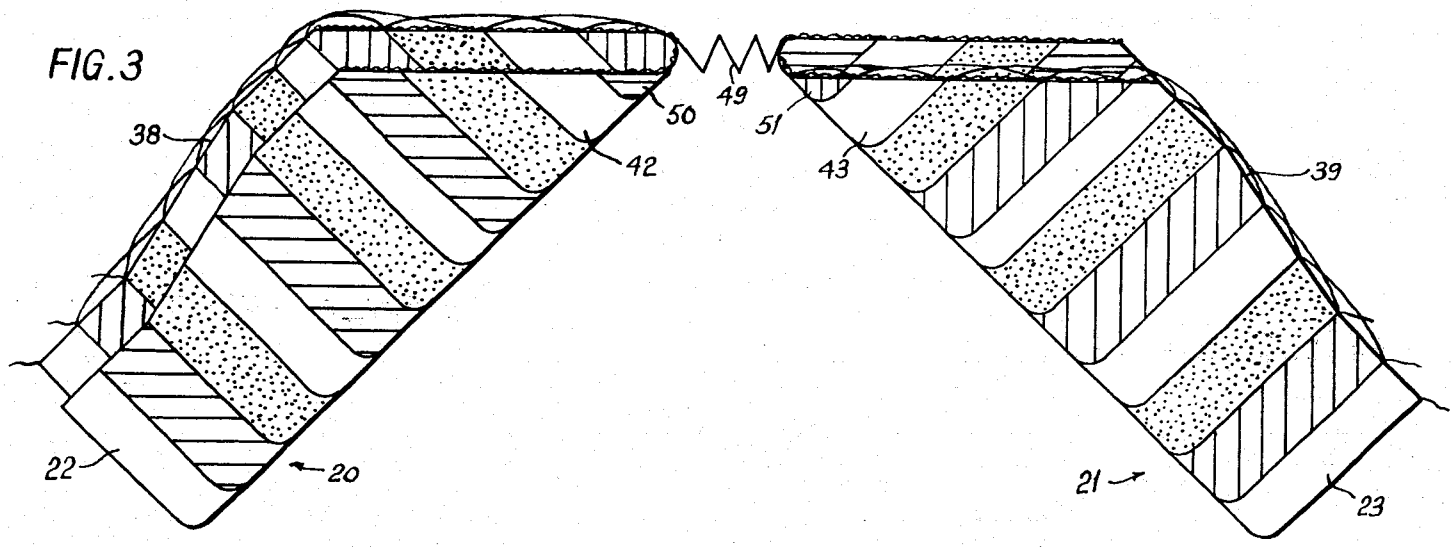

After knitting of the main parts of the sleeve portions 20 and 21 as shown in FIG. 2, two sleeve shoulder portions 42 and 43 are formed by knitting separate sets of U-shaped courses to constitute extensions of sleeve portions 20 and 21 (FIG. 3). The movements of the yarn carriers during the knitting of the portions 42 and 43 follow the same pattern as illustrated in FIG. 6 and yarn carriers are interchanged at regular intervals as in knitting the main parts of the sleeve portions so that different coloured yarns are used and stripes are formed. However, during knitting of the portions 42 and 43, needles on both needle beds are made progressively inactive in an inwards direction from the outermost active needles. The needles are made inactive without casting off loops from them, the procedure being illustrated in FIG. 8 where the ends 46 of successively shorter U-shaped courses are shown. The result is the shaping of the shoulder portions 42 and 43 to the form shown in FIG. 3. In this Figure, the inactive needles are holding loops along the greater parts of the portions 42 and 43 and the last active needles are to be found near the inner closed ends of these portions within the stripes 50 and 51.

Figure 9:
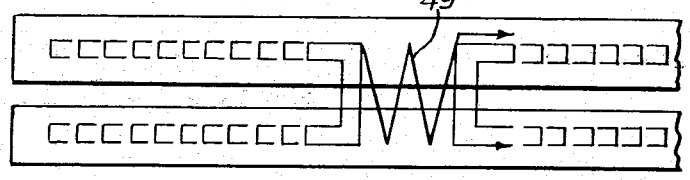
Figure 8:
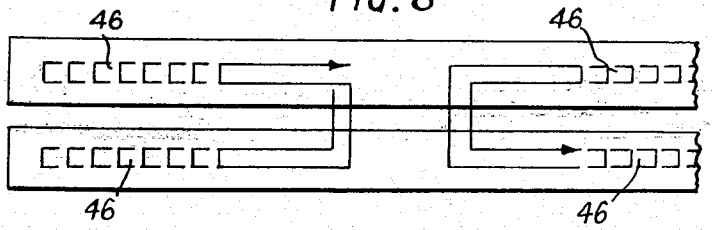
Figure 4:
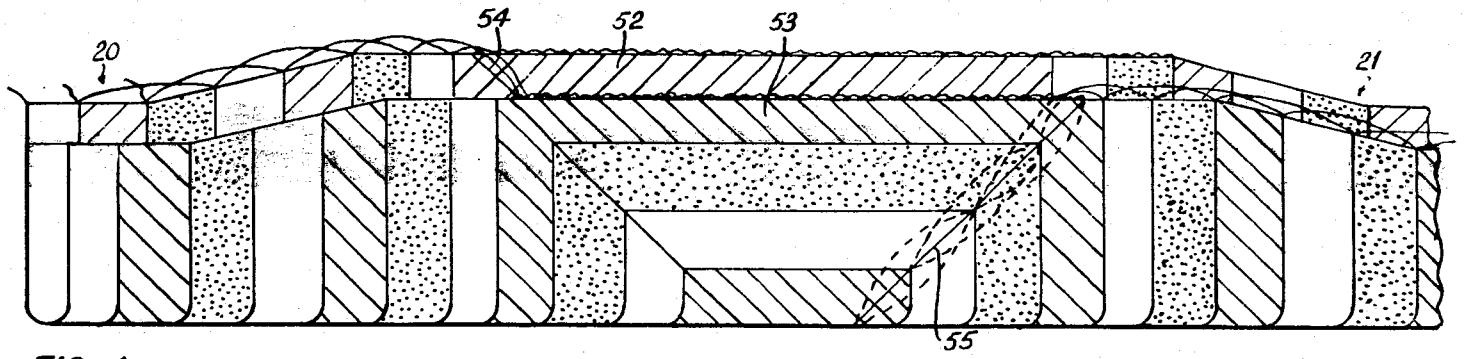

After completion of the sleeve shoulder portions 42 and 43 the next operation, also illustrated in FIG. 3, is to join the sleeve portions together by a course of rib knitting 49 also shown in FIG. 9. Thereafter two body shoulder portions 52 and 53 are formed by knitting two pieces of fabric, one on each bed 26 or 27. As the portions 52 and 53 are knitted, needles previously made inactive and still holding loops are brought progressively back into action, the direction of progression being in the opposite direction along the needle beds from that in which the needles were made inactive, that is starting with the innermost needles in each fabric portion and progressing outwardly. Thus, the sleeve and body shoulder portions are shaped and joined integrally with one another.

The striping is continued during the knitting of the body shoulder portions 52 and 53, that is knitting is carried on with successively different colours of yarn and loose lengths of yarn are thus formed along lines 54 and 55 in the portions 52 and 53 respectively along which yarns are taken out of and brought into knitting action.

Figure 10:
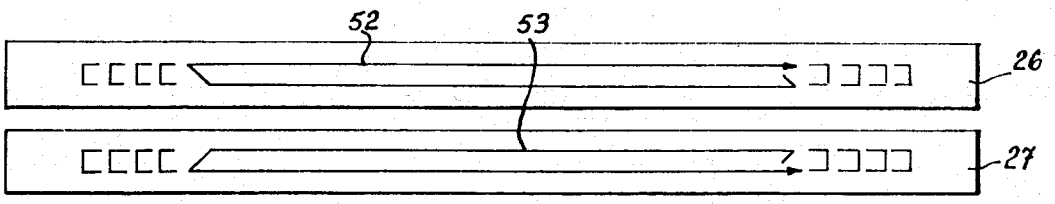
Figure 11:
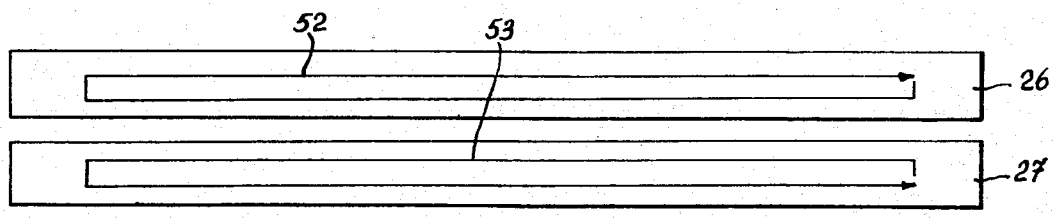
Figure 5:
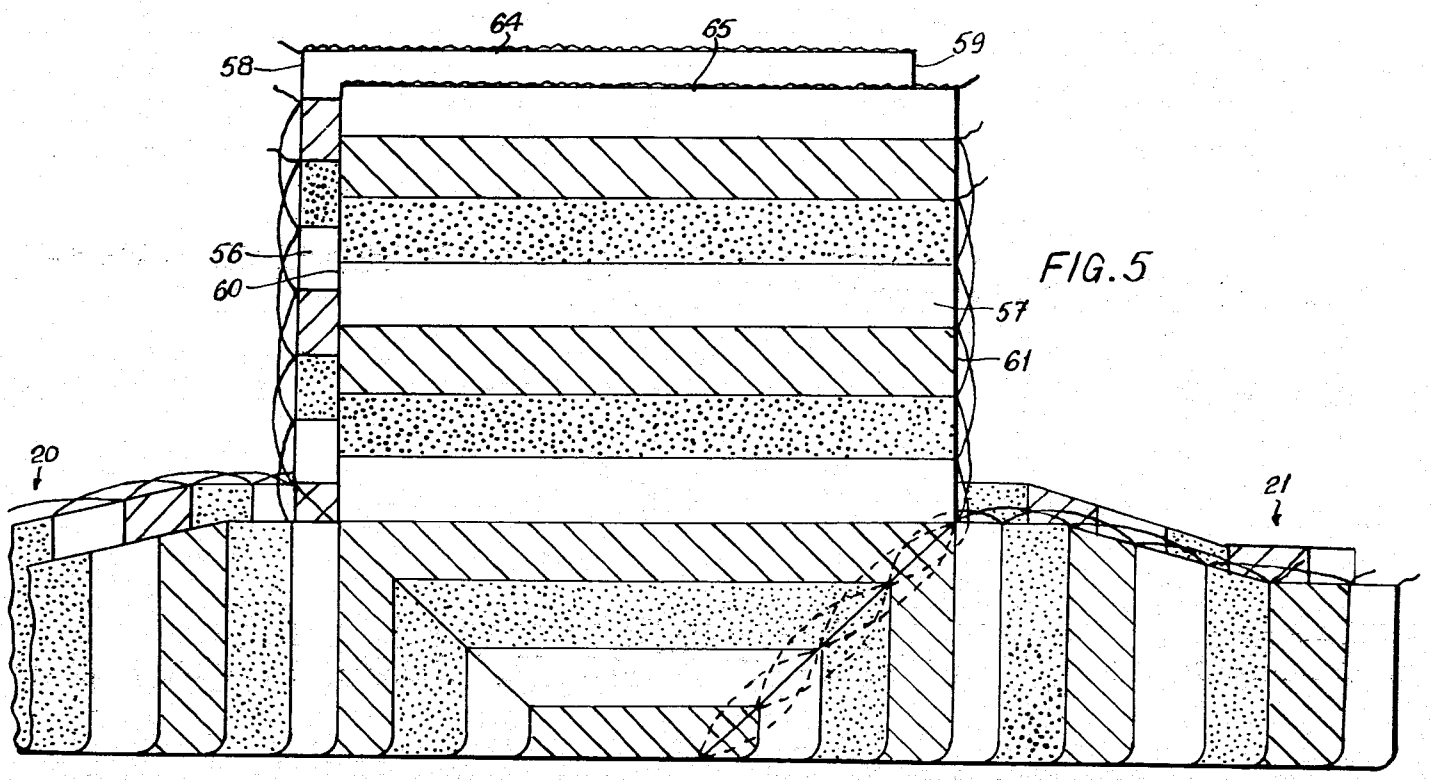

FIG. 10 illustrates a stage of knitting in which most of the needles previously taken out of action have been reintroduced and FIG. 11 shows the body shoulder portions 52 and 53 completed.

Thereafter striped knitting is continued separately on the two needle beds 26 and 27 to produce two body portions 56 and 57 for the blank each constituted by a piece of fabric knitted on one of the two needle beds. The body portion 56 has parallel side edges 58 and 59 and the body portion 57 has parallel side edges 60 and 61 and the loose lengths of yarn formed because of the striping are left along the edges 58 and 61.

When the waist 64 and 65 respectively of the body portion 56 and 57 is reached, a mock rib trimming is knitted in a conventional manner and the garment blank may then be pressed off the needles. Alternatively, knitting may be continued with waste yarn and/or a draw thread before another garment blank is started.

To make up the blank into a garment, it is turned inside out and the under arm join of each sleeve is seamed as are the side joins in the body. The loose lengths of yarn are either trimmed off by the seaming machine or they are folded into the seam and sewn into it. The waist edge also requires finishing.

The garment blank need not be striped and it can be knitted in the direction starting at the waist of the body and ending at the cuffs of the sleeve, the garment parts, the shaping and the sleeve-body joins being formed in an exactly similar way to that described above except for obvious changes consequent upon the different direction of knitting. For example, the sleeves are shaped by narrowing instead of widening.

Figure 12:
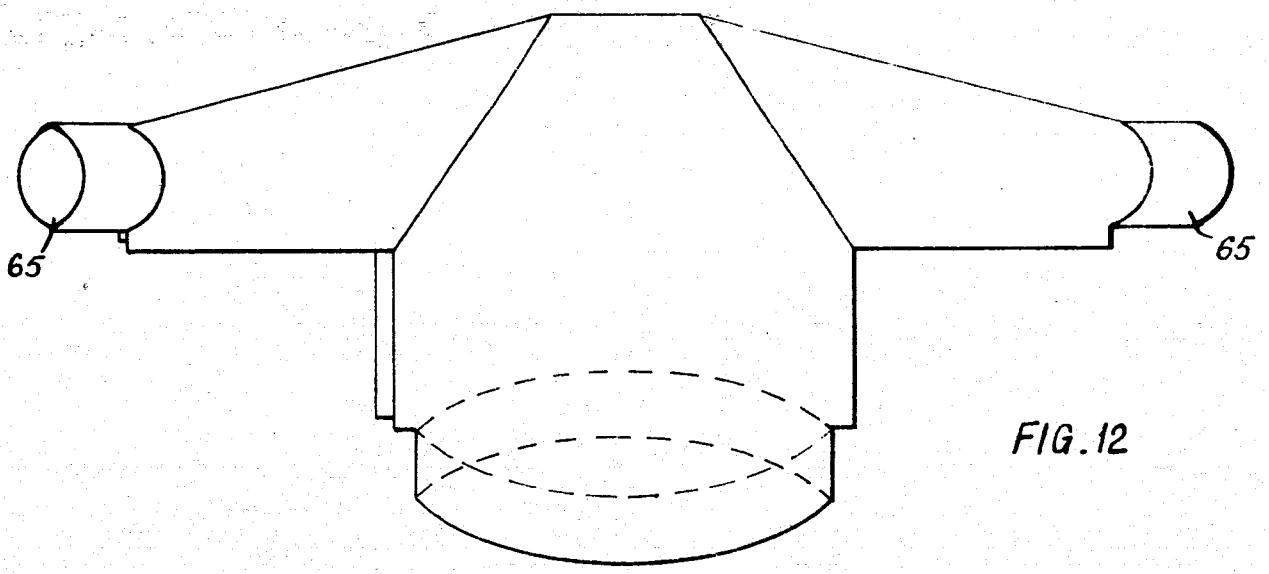

In a variant of the methods described above, the cuffs of the sleeves are knitted in mock rib construction in tubular form, without striping so that no seam need be formed in the cuffs to produce a garment from the blank. A garment blank produced with tubular cuffs 65 is shown in FIG. 12.

The above description of the formation of the sleeve portions is given in relation to single system knitting of each sleeve portion. The sleeve portions can, however, be knitted in double system in which a pair of cam systems in the cam box both operate needles of the same bed to knit in one traverse of the cam box across the needle beds. When using double system knitting, two courses A will, for example, be knitted immediately after one another (FIG. 7) followed by two courses B and so on to make up successive pairs of U-shaped courses. It is then desirable to mount the yarn carriers for each pair of cam systems on separate carrier rails and to arrange that in any one pair of U-shaped courses (formed by a single U-shaped movement of the yarn carriers) the same carrier of each pair of carriers always leads in the movement across the needle beds whichever the direction of traverse of the cam box. Such a movement of the yarn carriers ensures that the same yarn is used throughout any give U-shaped course.

What is claimed is:

1. A method of knitting a blank for a sleeved garment on a knitting machine having two opposed needle beds containing independently operable needles, said method comprising in either order the steps of a. forming two sleeve portions of the blank, each extending between a cuff and an underarm level of a sleeve of the garment, by knitting in reciprocatory manner on needles of the two opposed needle beds at two locations to form U-shaped courses, the joined ends of the two arms of each U-shaped course of each sleeve portion lying on the needle beds adjacent the joined ends of a correspondng U-shaped course of the other sleeve portion, and b. forming two body portions of the blank by knitting separately two pieces of fabric one on each of the two needle beds, said method also comprising c. forming a shoulder region of the blank to constitute a connection between the sleeve portions and the body portions, said shoulder region comprising two sleeve shoulder portions formed by knitting U-shaped courses to constitute an extension of each sleeve portion and two body shoulder portions formed by knitting two pieces of fabric to constitute extensions of said two body portions, and in the course of knitting one pair of said pairs of sleeve and body shoulder portions, making needles progressively inactive in an inwards direction from the outermost edges of the pair of portions, without casting off loops from those needles, and in the course of knitting the other of said pairs of sleeve and body shoulder portions bringing inactive needles holding knitted loops progressively back into operation in the opposite direction whereby the sleeve and body shoulder portions are shaped and joined to one another and a one-piece blank is formed having sleeve portions each open down one edge and body portions separated at the sides.

2. A method of making a sleeved garment comprising the steps of a. forming a garment blank by the method claimed in claim 1, b. seaming longitudinally along each sleeve portion of said blank to join the free ends of the successive U-shaped courses together, and c. seaming together the adjacent side edges of the body portion.

3. A method as claimed in claim 2 wherein, in the seaming operations, the extreme edges of the parts being seamed are removed.

* * * * *

UNITED STATES PATENT AND TRADEMARK OFFICE

CERTIFICATE OF CORRECTION

PATENT NO. : 3,990,271

DATED : November 9, 1976

INVENTOR(S) : Keith Jeffcoat

It is certified that error appears in the above-identified patent and that said Letters Patent are hereby corrected as shown below:

[30] Foreign Application Priority Data

January 7, 1975 United Kingdom 577/75

Column 5, line 52; "give" should be --given--

Signed and Sealed this

First Day of March 1977

[SEAL]

*Attest:*

RUTH C. MASON
*Attesting Officer*

C. MARSHALL DANN
*Commissioner of Patents and Trademarks*